United States Patent [19]

Hoshino

[11] 4,014,634

[45] Mar. 29, 1977

[54] POWDER MOLDING PRESS

[75] Inventor: Masayuki Hoshino, Shizuokaken, Japan

[73] Assignee: Iwatani & Co., Ltd., Osaka, Japan

[22] Filed: May 26, 1976

[21] Appl. No.: 690,180

[52] U.S. Cl. ..... 425/78; 425/135; 425/153; 425/150; 425/151

[51] Int. Cl.[2] ..... B30B 15/18

[58] Field of Search ..... 425/135, 151, 78, 153, 425/150

[56] References Cited

UNITED STATES PATENTS

| | | | |
|---|---|---|---|
| 3,160,919 | 12/1964 | Carter | 425/151 |
| 3,460,202 | 8/1969 | Graf et al. | 425/153 X |
| 3,816,043 | 6/1974 | Snelling et al. | 425/135 X |
| 3,850,560 | 11/1974 | Farrell | 425/150 |
| 3,857,658 | 12/1974 | Mugsnay | 425/150 X |
| 3,868,201 | 2/1975 | Jacobson et al. | 425/78 |

*Primary Examiner*—J. Howard Flint, Jr.
*Attorney, Agent, or Firm*—Bacon & Thomas

[57] ABSTRACT

A powder molding press, for compression-molding a raw powder between a pair of metal molds coupled to a pair of metal mold securing devices. At a preset spacing, the movement of the metal mold securing devices toward each other is electrically detected in order to cut off the driving means advancing the metal mold securing devices. In addition, the movement of the metal mold securing device is mechanically stopped by means of stoppers, with the result that the final position of the metal molds can be precisely regulated.

10 Claims, 8 Drawing Figures

POWDER MOLDING PRESS

BACKGROUND OF THE INVENTION

1. Field of the Invention

This invention deals with the manufacture of machine parts by compression-molding metal powder between a pair of metal molds.

2. Description of the Prior Art

Normally, in conventional molding presses, stoppers are used to mechanically regulate the mutual travel toward each other of a pair of metal mold securing devices thereby determining the final position of the metal molds. The movement of the metal mold securing devices, as driven, is arrested by their impinging on the stoppers. Consequently, as a result of the arrested movement, a strong driving force is generated which acts on both the stoppers and the metal mold securing devices often resulting in their breakage or deformation. Additionally, old fashioned stoppers were incorporated within the metal mold securing devices and as a result, the metal mold became larger in size and greater in height due to the vertical operation of this kind of press.

In fact; though the size accuracy in the pressing direction may be kept relatively high, through the use of the stoppers assuming mechanical position control, the incline accuracy of the compressed surface of the molded parts deteriorates as the attitude of the metal mold securing devices is distrubed by the impingement at the time of regulation.

SUMMARY OF THE INVENTION

The present invention overcomes these drawbacks inherent in the prior art. It is therefore an object of this invention to prevent the apparatus from enlarging in size by furnishing it with a stopper in a suitable location in relation to a pair of metal mold securing devices, which location had not been previously used.

Another object of this invention is to automatically cut off the driving means advancing the metal mold securing devices, when both metal molds approach the final pressing position, in order to prevent the impinging reaction force, acting on both the stoppers and the metal mold securing devices, from causing any breakage or deformation.

A further object of this invention is to enhance the size accuracy in the compressing direction as well as the incline accuracy on the compressed surface of molded parts by correctly regulating not only the position but also the attitude of the metal mold securing devices when the stoppers and the metal mold securing devices impinge upon each other.

The present invention accomplishes these objects by providing a powder molding press for compression-molding a raw powder between a pair of metal molds. The press comprises a pair of metal molds coupled to a pair of metal mold securing devices which are driven to advance towards or separate from each other. A pair of stoppers impinges upon the upper metal mold securing device as it moves toward the lower metal mold securing device. The stoppers are secured on the machine frame at a suitable place relative to both metal mold securing devices and on both sides of either metal mold. Detecting means, positioned between the stoppers and the metal mold securing devices, electrically detects impingement of the stoppers upon the upper metal mold securing device, and cuts off the driving means advancing the upper metal mold securing device. The diameter of the surface of the upper metal mold securing device impinging on the stoppers is larger than that of the molded parts when compared with conventional presses which have stoppers incorporated within the metal mold securing devices.

In the present invention, the pair of stoppers impinging upon the upper metal mold securing device are located along both sides of either metal mold and at a suitable position relative to the pair of metal mold securing devices driven to advance toward or separate from each other. Thus, a particular space for the stoppers is not required. As a result, it is possible to miniaturize the press as compared with a press where the stoppers are incorporated within the metal mold securing devices. In addition, since the impingement of the stoppers upon the upper metal mold securing device is electrically detected, at once cutting off the means driving the latter, the driving force does not cause breakage and deformation to either the former or the latter, if any overrun occurs after detection due to lag action. However, since the stoppers and the metal mold securing devices imping upon each other via an impinging surface which is far larger than that of the molded parts, the metal mold securing devices can maintain their attitude along the impinging surface. The position and attitude of the metal mold in the final pressing position can be correctly regulated, with the result that it is possible to enhance the size accuracy in the pressing direction as well as the incline accuracy of the pressed surface of the molded parts.

BRIEF DESCRIPTION OF THE DRAWINGS

Following is a description of the details of the invention as manifested in a preferred embodiment.

DESCRIPTION OF THE PREFERRED EMBODIMENT

Figure 1:
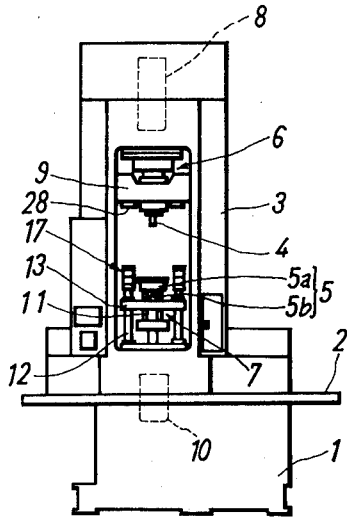
FIG. 1 is an elevational view of the press.

In FIG. 1, there is shown a base 1, a work bench 2, an arched main frame 3, an upper metal mold 4, a lower metal mold 5, an upper metal mold securing device 6, and a lower metal mold securing device 7. The upper metal mold securing device 6 comprises a slide table 9, at the bottom of which is fitted the metal mold 4. The slide table 9 may be driven up and down along the main frame 3 by a hydraulic cylinder 8 incorporated in the upper part of the main frame 3. The lower metal mold securing device 7 comprises a movable metal mold 5*a* mounted on a plurality of slide rods 11. The metal mold 5*a* slides up and down in a guide 13, which guide 13 is secured on the main frame 3 by means of the struts 12. The sliding of the metal mold 5*a* is caused by a hydraulic cylinder 10 incorporated in the base 1. A fixed metal mold 5*b* is secured on the guide 13.

Each step in the operation of the press is explained with reference to FIG. 2*a* to 2*d*.

Figure 2:
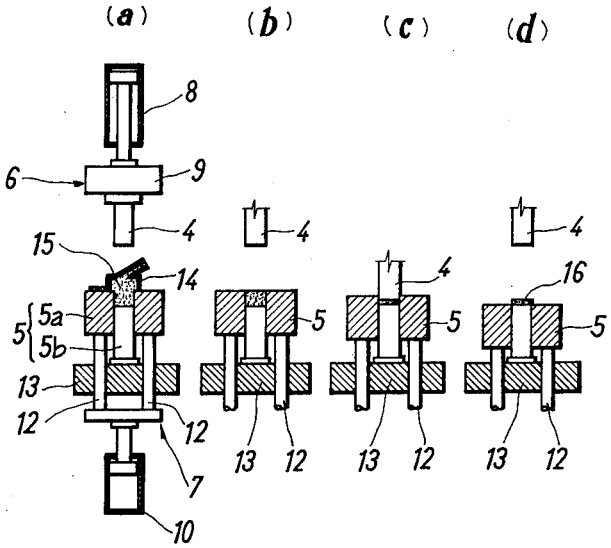
FIGS. 2*a* through 2*d* are longitudinal sectional front views of the essential parts of the press illustrating the molding steps.

In FIG. 2*a* upper metal mold securing device 6 and the lower metal mold securing device 7 are at their upper limits. A powder supplying means 14 is positioned on the lower metal mold 5 and raw powder 15 is supplied into the mold from a hopper (not shown in the figure).

In FIG. 2*b* the powder supplying means 14 is withdrawn by sliding it along the upper face of the movable metal mold 5*a* and a fixed quantity of powder 15 fills up the hole created by the fixed metal mold 5*b* and the movable metal mold 5*a*.

In FIG. 2*c* the upper metal mold 4 is lowered to compress powder 15, while the movable mold 5*a* simultaneously lowers slightly resulting in the powder 15 being uniformly compressed.

In FIG. 2*d* the upper metal mold 4 is raised, the upper surface of the movable metal mold 5*a* is lowered to the level of the top of the fixed metal mold 5*b* and the molded part 16 is thereby exposed. Then, as shown in FIG. 2*a*, when the powder supplying means 14 is again positioned over the upper face of the movable metal mold 5*a*, the powder supplying means 14 pushes the molded part 16 out of the press, opening a powder filling hole in the lower metal mold 5.

Thus, ends one operation cycle. The successive repitition of this operation continuously produces molded parts 16.

Figure 3:
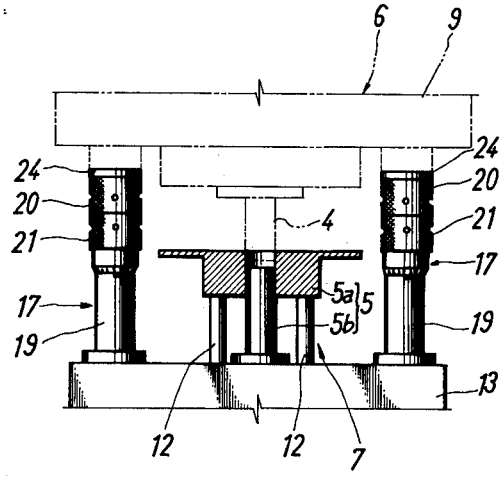
FIG. 3 is a partial longitudinal sectional elevation view of the stopper construction.

In the present invention, when the upper metal mold 4 has reached its prescribed minimum descending point, its position and attitude is regulated by the mechanism shown in FIGS. 1 and 3. A pair of pillar-shaped stoppers 17 are secured on the fixed guide 13 at a suitable position relative to both the upper metal mold securing device 6 and the lower metal mold securing device 7 and on both sides of the lower metal mold 5. The stoper 17, shown in FIG. 4. comprises a basic shaft 19 fixed on the guide 13 with a screw thread 18 formed on its top part. Upper and lower regulator collars 20 and 21 are locked on the screw threads 18. A disk 24 is mounted on top of the upper collar 20 and has a strut 23 inserted through the upper collar 20 into a hole 22 formed in the center of the upper part of the basic shaft 19. Stopper 17 is so constructed that its height can be regulated by automatic regulation of the collars 20 and 21. The basic shaft 19 and the lower collar 21 are provided with a main graduated scale 25 and a supplementary graduated scale 26, respectively. By use of these scales the height of the left and right stoppers 17 is able to be precisely regulated. In addition, stopper 17, as shown in FIG. 5, can be regulated to any considerable degree of height with the help of spacers 27*a*, 27*b*, and 27*c* interposed between upper collar 20 and disk 24.

Figure 4:
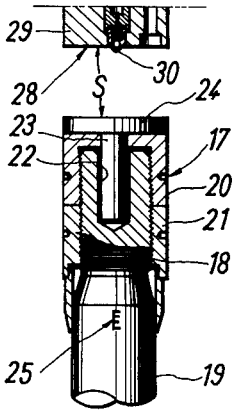
FIG. 4 is an enlarged vertical sectional front view of the stopper construction.
Figure 5:
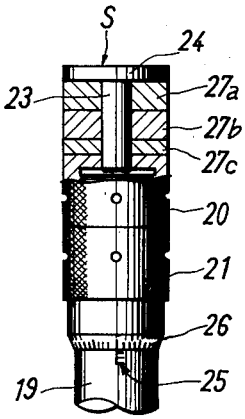
FIG. 5. is an enlarged vertical sectional front view of a part of the regulated stopper construction.

As shown in FIG. 4, at a spot on the bottom of the slide table 9 of the upper metal mold securing device 6 are attached contact detecting means 28. These contact detecting means 28 are electric switches which face stopper 17. These switches operate electromagnetic control valves (not shown in the figure) located in the hydraulic cylinder 8 which drive the slide table 9. A contactor 30, attached to a block 29, is pushed upwardly against a spring bias when it comes in contact with the disk 24 on the top of the stopper 17, thereby acuating the control valve. and changing it over to a neutral position.

The diameter of the impinging surfaces S of the disk 24 and the block 29 of the detecting means is greater than that of the molded parts.

Since the descending drive of the upper metal mold securing device 6 is cut off in such a way that the upper metal mold securing device 6 is supported by stoppers 17, there if no danger that the stopper 17 and the detecting means 28 impinge upon each other with a strong driving force. In addition, since the detecting means 28 is supported along a large impinging surface area S, the inclining direction of the metal mold 4 can be always accurately and constantly maintained, even if a back-flash happens in the guideway between the slide table 9 and the main frame 3.

I claim:

1. A compression-molding press comprising:

a machine frame;

a first metal mold securing device slideably secured to said machine frame;

a second metal mold securing device secured to said machine frame;

a driving means for slideably advancing said first metal mold securing device towards said second metal mold securing device;

a first metal mold coupled to said first metal mold securing device;

a second metal mold coupled to said second metal mold securing device;

stopper means, positioned between said first and second metal mold securing devices, and impinging upon one of said metal mold securing devices when said first metal mold securing device is advanced a predetermined distance toward said second metal mold securing device;

detecting means positioned between said stopper means and said one of said metal mold securing devices for detecting impingement of said stopper means upon said on of said metal mold securing devices; and a means, included in said detecting means, for cutting off said driving means advancing said first metal mold securing device towards said second metal mold securing device, upon detection of impingement by said detecting means, thereby preventing a strong driving force acting on said impinging stopper means and said one of said metal mold securing devices, saving said stopper means and said one of said metal mold securing devices from breakage and deformation.

2. A compression-molding press as described in claim 1 wherein said detecting means is attached to said first metal mold securing device

3. A compression-molding press as described in claim 1 wherein said stopper means is fixedly secured to said machine frame.

4. A compression-molding press as described in claim 1 wherein said detecting means electrically detects said impingement of said stopper means upon said one of said metal mold securing devices.

5. A compression-molding press as described in claim 1 wherein the diameter of the impinging surface of said stopper means and said one of said metal mold securing devices is larger than the diameter of said first and second metal molds.

6. A compression-molding press as desccribed in claim 1 wherein said stopper means is secured at a suitable location relative to said first and second metal mold securing devices and along side one of said first and second metal molds.

7. A compression-molding press as described in claim 1 wherein said stopper means includes a height adjusting means.

8. A compression-molding press as described in claim 7 wherein the height adjusting means of said stopper means includes a screw thread formed on the top part of said stopper means and regulator collar means locked on the screw threads.

9. A compression-molding press as described in claim 8 wherein the height adjusting means of said stopper means further includes a disk mounted on said regulator collar means.

10. A compression-molding press as described in claim 7 wherein said stopper means has a graduated scale means for regulating the height of said height adjusting means.

* * * * *